US009236667B2

(12) United States Patent
Shimizu et al.

(10) Patent No.: US 9,236,667 B2
(45) Date of Patent: Jan. 12, 2016

(54) CONNECTION STRUCTURE

(71) Applicant: YAZAKI CORPORATION, Tokyo (JP)

(72) Inventors: Tomohiko Shimizu, Shizuoka (JP); Tetsuya Sekino, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/598,393

(22) Filed: Jan. 16, 2015

(65) Prior Publication Data

US 2015/0126080 A1 May 7, 2015

Related U.S. Application Data

(63) Continuation of application No. PCT/JP2013/072551, filed on Aug. 23, 2013.

(30) Foreign Application Priority Data

Sep. 6, 2012 (JP) ..... 2012-196657

(51) Int. Cl.
*H01R 4/10* (2006.01)
*H01R 4/18* (2006.01)
(Continued)

(52) U.S. Cl.
CPC ..... *H01R 4/183* (2013.01); *H01R 4/70* (2013.01); *H01R 43/28* (2013.01); *H01R 4/185* (2013.01)

(58) Field of Classification Search
CPC ..... H01R 4/185; H01R 4/20; H01R 4/188; H01R 43/058
USPC ..... 439/877, 878, 882
See application file for complete search history.

(56) References Cited

U.S. PATENT DOCUMENTS 7,174,633 B2 * 2/2007 Onuma ..... H01R 4/04 29/854
7,905,755 B1 * 3/2011 Martauz ..... H01R 4/184 205/118

(Continued)

FOREIGN PATENT DOCUMENTS

JP 2010-267532 A 11/2010
JP 2011-243328 A 12/2011
WO 2011/122622 A1 10/2011

OTHER PUBLICATIONS

International Preliminary Report on Patentability and English language Written Opinion of the International Search Report for PCT/JP2013/072551.

(Continued)

*Primary Examiner* — Hien Vu
(74) *Attorney, Agent, or Firm* — Kenealy Vaidya LLP

(57) ABSTRACT

In a connection structure, electric wire includes an inclined sheath section between an exposed core wire section and a whole circumferential sheath section. In the inclined sheath section, an end surface of the insulating sheath on one end side in a longitudinal direction inclines in a direction intersecting the longitudinal direction and thereby a portion of the core wire is exposed. Each of crimping pieces of a terminal has a core wire crimping section that crimps the exposed core wire section, a whole circumferential sheath crimping section that crimps the whole circumferential sheath section, and an inclined sheath crimping section that crimps the inclined sheath section. The terminal is crimped to the electric wire so that the end surface of the inclined sheath section faces a base plate section of the terminal.

4 Claims, 10 Drawing Sheets

(51) Int. Cl.
*H01R 4/70* (2006.01)
*H01R 43/28* (2006.01)

(56) References Cited

U.S. PATENT DOCUMENTS 9,071,045 B2 * 6/2015 Furukawa ..... H01R 4/185
9,118,123 B2 * 8/2015 Kawamura ..... H01R 4/187
2013/0095708 A1 4/2013 Mitose et al.
2013/0130569 A1 5/2013 Sato

OTHER PUBLICATIONS

International Search Report and Written Opinion of the International Search Report for PCT/JP2013/072551 dated Oct. 15, 2013.

* cited by examiner

CONNECTION STRUCTURE

CROSS REFERENCE TO RELATED APPLICATIONS

This application is a continuation of PCT application No. PCT/JP13/072551, which was filed on Aug. 23, 2013 based on Japanese Patent Application (No. 2012-196657) filed on Sep. 6, 2012, the contents of which are incorporated herein by reference.

BACKGROUND OF THE INVENTION

1. Field of the Invention

The present invention relates to a connection structure between an electric wire and a terminal.

2. Description of the Related Art

In the related art, various aspects are known as a connection structure between an electric wire having a core wire and an insulating sheath that covers an outer circumferential surface of the core wire, and a terminal crimped to the electric wire (refer to PTL 1).

CITATION LIST

Patent Literature

[PTL 1] JP-A-2011-243328

SUMMARY OF THE INVENTION

First, a related-art connection structure will be described with reference to FIG. 10. FIG. 10 is a perspective view illustrating the related-art connection structure.

In the connection structure illustrated in FIG. 10, a metallic cover 130A is mounted on a conductor Wa exposed at a terminal section of an electric wire W. The cover 130A has half pipe portion 131 with a circular-arc cross-section on one end side in a longitudinal direction, and has an annular portion 132 with a substantially round cross-section on the other end side. After the mounting of the cover 130A, the half pipe portion 131 is arranged on a tip side of the conductor Wa so as to cover the upper side of the conductor Wa, and the annular portion 132 fits to an outer circumferential surface of the conductor Wa. The terminal section of the electric wire W mounted with the cover 130A in this way is set a base plate section 121 of a wire connection section 112 of a terminal 120, in a posture where the conductor Wa exposed from an open section 131*a* of the half pipe portion 131 is directed to the base plate section 121 side. Then, in the state where the terminal section of the electric wire W is set on the base plate section 121, a conductor crimping piece 122 and a covering crimping piece 124 of the wire connection section 112 are bent inward and are thereby crimped to the terminal section of the electric wire W. Accordingly, the terminal 120 is crimped to the electric wire W. In this connection structure, entering of water to the conductor Wa from the outside can be inhibited. Additionally, since an exposed portion of the conductor Wa is small in this connection structure, corrosion can be suppressed.

In recent years, further cost reduction has been desired in regard to the connection structure between the electric wire and the terminal.

The invention has been made in view of the above-described circumstances, and an object thereof is to provide a connection structure capable of realizing cost reduction, while ensuring the performance of inhibiting the entering of water to a conductor of an electric wire and the performance of suppressing the corrosion of the conductor.

In order to achieve the aforementioned object, the connection structure related to the invention is characterized by the following (1) to (4).

(1) A connection structure between an electric wire having a core wire and an insulating sheath that covers an outer circumferential surface of the core wire, and a terminal crimped to a terminal section of the electric wire on one end side in a longitudinal direction, wherein the electric wire includes:

an exposed core wire section in which a whole outer circumferential surface of the core wire is exposed to the terminal section from the insulating sheath;

a whole circumferential sheath section in which the outer circumferential surface of the core wire is covered with the insulating sheath; and an inclined sheath section that is formed between the exposed core wire section and the whole circumferential sheath section, wherein the inclined sheath section continues to the whole circumferential sheath section, wherein, in the inclined sheath section, an end surface of the insulating sheath on one end side in the longitudinal direction inclines in a direction intersecting the longitudinal direction and thereby a portion of the core wire is exposed, wherein the terminal includes a connection section that is electrically connected to a mating terminal, a base plate section that is provided continuously with the connection section, and a pair of crimping pieces that are erected from both side edges of the base plate section, respectively, wherein each of the crimping pieces has a core wire crimping section that crimps the exposed core wire section, a whole circumferential sheath crimping section that crimps the whole circumferential sheath section, and an inclined sheath crimping section that crimps the inclined sheath section, and wherein the terminal is crimped to the electric wire so that the end surface of the inclined sheath section faces the base plate section.

(2) The connection structure according to the above configuration (1), wherein a portion of the insulating sheath of the inclined sheath section is crimped to the core wire crimping sections.

(3) The connection structure according to the above configuration (1) or (2), wherein the core wire crimping section and the inclined sheath crimping section of each of the crimping pieces are partitioned by a slit that extends toward the base plate section from a tip of the crimping piece in an erection direction thereof.

(4) The connection structure according to any one of the above configurations (1) to (3), wherein waterproofing sections extending toward the connection section are formed at end portions of the core wire crimping sections on the connection section side.

Meanwhile, when the cover 130A is used in the above-described related-art connection structure, since the outer shapes of the conductor crimping piece 122 and the covering crimping piece 124 after crimping are different from each other in outer shapes, a gap may be formed in portions where the outer shapes are switched. The gap is apt to be formed on the upper side of the wire connection section 112. If the gap is present, moisture may enter a contact portion between the core wire and the terminal from the gap, and the core wire may corrode.

In contrast, in the connection structure of the configuration of the above (1), the inclined end surface faces the base plate section in the inclined sheath section formed between the exposed core wire section crimped by the core wire crimping sections and the whole circumferential sheath section crimped by the whole circumferential sheath crimping sections. Accordingly, the half surface of the inclined sheath section where the insulating sheath much remains is arranged so as to face the upper side (namely, the tip sides of the crimping pieces in the erection direction). For this reason, even if a gap is formed in the inclined sheath crimping sections serving as portions where the outer shapes are switched, the gap is easily filled with the insulating sheath of the inclined sheath section. Particularly, since the inclined end surface of the inclined sheath section that is easily deformed in the up-down direction is crimped in the inclined sheath crimping sections, the gap is easily filled. As a result, entering of water into a contact portion between the core wire and the terminal from the gap is suppressed, and the core wire is prevented from corroding due to the entered water. Accordingly, according to the connection structure (1) of the above (1), waterproofing of the contact portion between the core wire and the terminal can be achieved with a simple structure without using the metallic cover unlike the related-art connection structure between the electric wire and the terminal, that is, without increasing the number of parts.

Additionally, the half surface of the inclined sheath section where the core wire is exposed much is arranged so as to face the lower side (namely, the base end sides of the crimping pieces in the erection direction). For this reason, if the electric wire is crimped by the crimping pieces, the exposed core wire is electrically connected to the base plate section of the terminal in the inclined sheath section. As a result, the electrical connection performance between the core wire and the terminal is not easily impaired.

In the connection structure of the above configuration (2), since the terminal is crimped to the electric wire so that a portion of the insulating sheath of the inclined sheath section is crimped to the core wire crimping sections, the insulating sheath of the inclined sheath section extends over the entire inclined sheath crimping sections. For this reason, the gap formed in the inclined sheath crimping sections after crimping is effectively and easily filled with the insulating sheath.

In the connection structure of the above configuration (3), the core wire crimping section and the inclined sheath crimping section of each crimping piece is partitioned by the slit that extends toward the base plate section from the upper end. Since the rigidity of the crimping pieces decreases by forming the slit, the crimping pieces are easily crimped. Additionally, since the gap is easily formed in the portion where the slit is formed, the portion where the gap is formed is easily predicted, and the gap is reliably filled with the insulating sheath. Additionally, since a portion of the electric wire can be visually recognized from the slits after crimping, the worker can confirm the position of the insulating sheath after crimping by visual observation.

In the connection structure of the above configuration (4), the waterproofing sections extending toward the connection section are formed at end portions of the core wire crimping sections on the connection section side. The waterproofing sections are bent toward the base plate section after crimping. Accordingly, the exposed core wire section is covered with the bent waterproofing sections. For this reason, entering of water into the exposed core wire section is suppressed, and the core wire is prevented from corroding due to the entered water.

According to the connection structure related to the invention, it is possible to provide a connection structure capable of realizing cost reduction, while ensuring the performance of inhibiting the entering of water to the conductor of the electric wire and the performance of suppressing the corrosion of the conductor.

The invention has been briefly described above. Moreover, the details of the invention will be further clarified by reading through modes (hereinafter referred to as "embodiments") for carrying out the invention with reference to the attached drawings.

BRIEF DESCRIPTION OF THE DRAWINGS

In FIG. 3, boundary lines between an exposed core wire section, an inclined sheath section, and a whole circumferential sheath section are shown by dotted lines, and a boundary line between an upper half surface and a lower half surface is shown by a two-dot chain line.

FIG. 5A and FIG. 5B illustrate a peeling process of removing a portion of an insulating sheath of the electric wire, FIG. 5C illustrates a conductor arrangement process of arranging the electric wire at a crimping position in the terminal, and FIG. 5D illustrates a crimping process of crimping a crimping piece.

DETAILED DESCRIPTION OF THE EXEMPLARY EMBODIMENTS

Specific embodiments of a connection structure related to the invention will be described below, referring to FIGS. 1 to 9.

First Embodiment

FIGS. 1 to 5D illustrate a connection structure 1 between an electric wire and a terminal related to a first embodiment. Hereinafter, in the present specification, description will be made with a front side (F), a rear side C, an upper side (U), a lower side (D), a left side (L), and a right side (R) being defined as indicated by arrows in FIG. 1.

Figure 1:
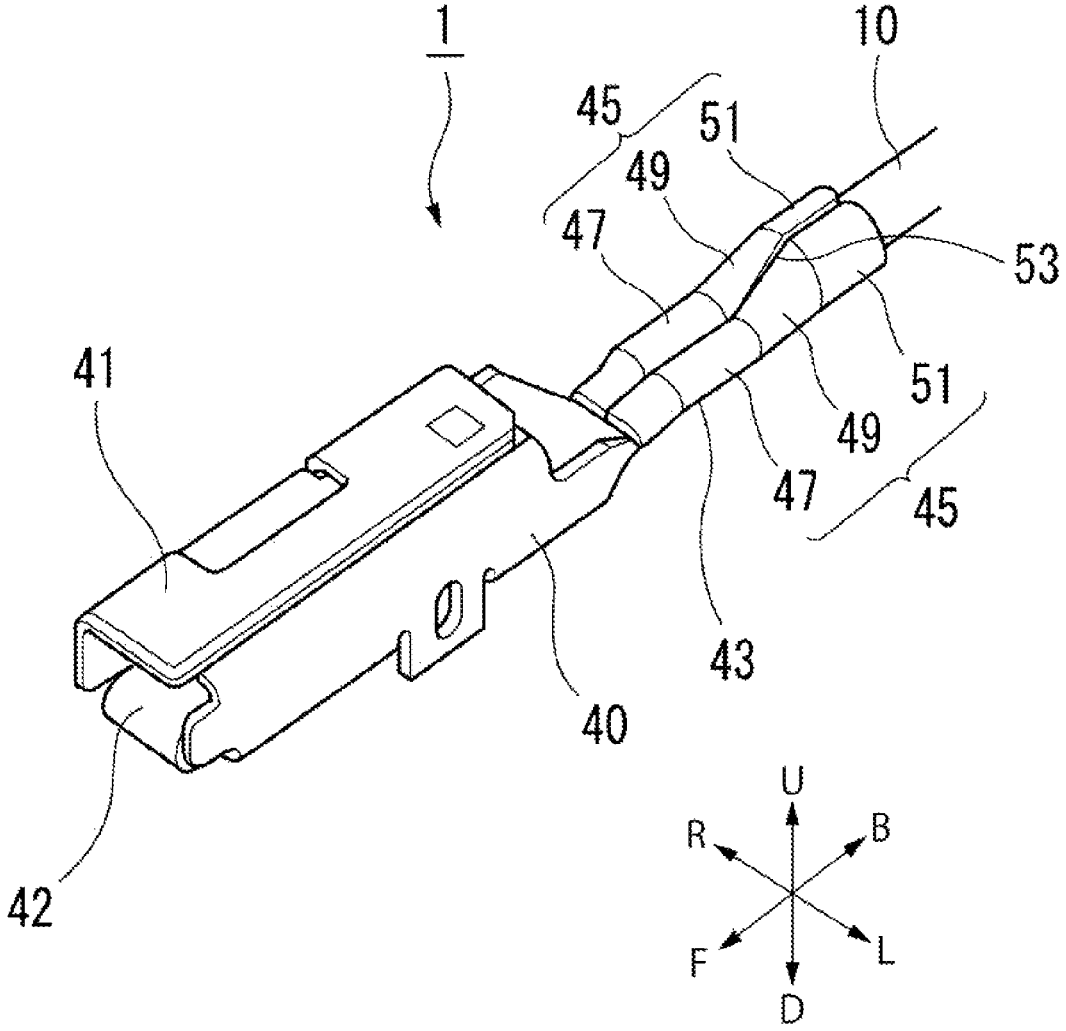
FIG. 1 is a perspective view illustrating a connection structure related to a first embodiment.

The connection structure 1, as illustrated in FIG. 1, is formed at an electric wire with a terminal in which an electric wire 10 and a terminal 40 made of conductive metal are electrically connected. In the connection structure 1, the terminal 40 is crimped to the electric wire 10.

First, respective members in a state before crimping will be described.

Figure 3:
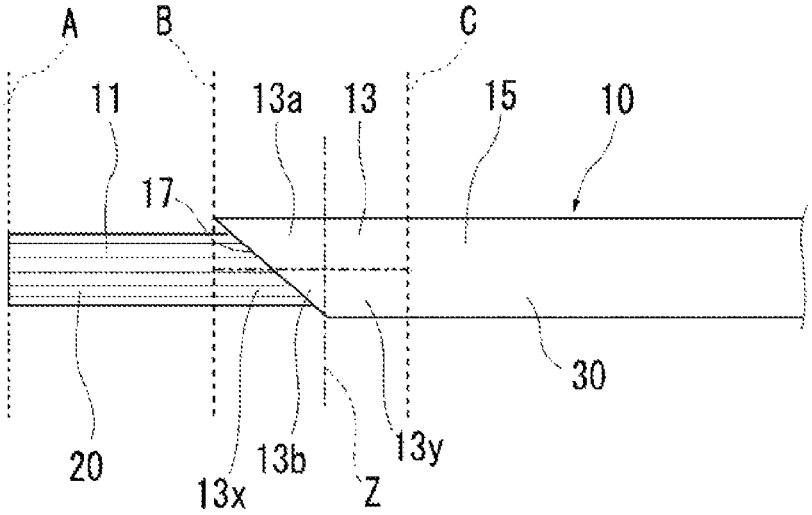
FIG. 3 is a side view illustrating an electric wire in a state before crimping.

The electric wire 10, as illustrated in FIG. 3, includes a core wire 20 made of conductive metal, and an insulating sheath 30 made of an insulating material that covers an outer circumferential surface of the core wire 20. The electric wire 10 has, at a terminal section on a front end side of the electric wire 10 in a longitudinal direction, an exposed core wire section 11 formed by the insulating sheath 30 being covered therefrom and the whole outer circumferential surface of the core wire 20 being exposed. Additionally, the electric wire 10 has a whole circumferential sheath section 15 covered with the insulating sheath 30 on the whole outer circumferential surface of the core wire 20. Moreover, the electric wire 10 has an inclined sheath section 13 formed in the shape of a sliced-off bamboo (that is, like a bamboo pointed by obliquely slicing off a tip) between the exposed core wire section 11 and the whole circumferential sheath section 15. In the present embodiment, the inclined sheath section 13 is formed such that a portion of the insulating sheath 30 is removed, an end surface 17 of the insulating sheath 30 on the front side is inclined in the front-back direction (namely, in the longitudinal direction of the electric wire 10), and thereby, a portion of the core wire 20 is exposed. In FIG. 3, the exposed core wire section 11, the inclined sheath section 13, and the whole circumferential sheath section 15 are illustrated in a divided manner by dotted lines A, B, and C, respectively. A normal line of the end surface 17 that is formed in a planar shape intersects each of the longitudinal direction (namely, the front-back direction) of the electric wire 10 and a direction perpendicular to the longitudinal direction. Accordingly, in the inclined sheath section 13, a covered portion in which the core wire 20 is covered with the insulating sheath 30 is wide on the upper half surface 13*a*, while an exposed section in which the core wire 20 is exposed from the insulating sheath 30 is wide on the lower half surface 13*b*. In FIG. 3, the upper half surface 13*a* and the lower half surface 13*b* are illustrated in a divided manner by a two-dot chain line. The electric wire 10 (namely, the electric wire 10 illustrated in FIG. 5B) including the exposed core wire section 11 and the inclined sheath section 13, as illustrated in FIG. 3, is formed by removing (in other words, cutting off) a portion of the insulating sheath 30 of the terminal section on the front end side in the longitudinal direction of the electric wire 10 (namely, the electric wire 10 illustrated in FIG. 5A) in a state where the whole outer circumferential surface of the core wire 20 is covered with the insulating sheath 30.

In addition, when the viewpoint of the inclined sheath section 13 is changed, the inclined sheath section 13, as illustrated in FIG. 3, can be said to include a non-exposed section 13*y* that extends from the whole circumferential sheath section 15 and in which the whole outer circumferential surface of the core wire 20 is covered with the insulating sheath 30, similar to the whole circumferential sheath section 15, and a partially-exposed section 13*x* that extends from the non-exposed section 13*y* and has the end surface 17 accompanying the tapering of the insulating sheath 30. Additionally, the non-exposed section 13*y* and the partially-exposed section 13*x* can be said to be divided by a plane Z that passes through a point where the end surface 17 of the partially-exposed section 13*x* begins to be created from the non-exposed section 13*y* toward the partially-exposed section 13*x* (in other words, a point where the insulating sheath 30 begins to be tapered) and extends in the direction orthogonal to the longitudinal direction of the electric wire 10. When viewed in this way, in the partially-exposed section 13*x*, a covered portion in which the core wire 20 is covered with the insulating sheath 30 is wider than an exposed portion in which the core wire 20 is exposed from the insulating sheath 30, on the upper half surface 13*a*, while the exposed portion is wider than the covered portion on the lower half surface 13*b*.

Figure 2:
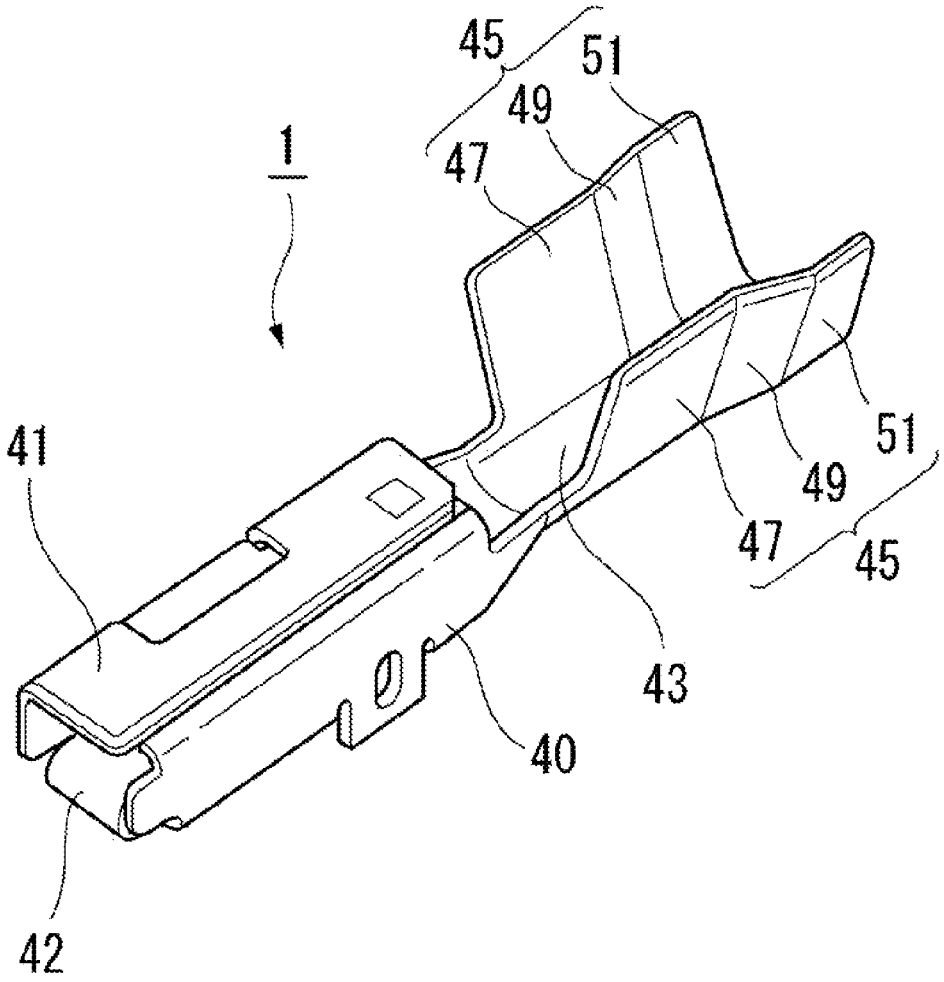
FIG. 2 is a perspective view of a state before the crimping of a terminal of the first embodiment.

The terminal 40 is a so-called female terminal, and as illustrated in FIG. 2, includes a box-shaped connection section 41 that houses a connecting spring piece 42 that is electrically connected to a mating terminal (not illustrated), a rectangular base plate section 43 that is provided continuously with the connection section 41, and a pair of crimping pieces 45 and 45 that are erected from both side edges of the base plate section 43, respectively. The base plate section 43 and the crimping pieces 45 and 45 are formed so as to have a substantially U-shaped cross-section as a whole, in a cross-sectional view in the direction orthogonal to the front-back direction. The terminal 40 is integrally formed by bending a member punching-formed from one conductive metal plate.

Each crimping piece 45 has a core wire crimping section 47 that crimps the exposed core wire section 11, an inclined sheath crimping section 49 that is provided continuously with a rear side of the core wire crimping section 47 and crimps the inclined sheath section 13, and a whole circumferential sheath crimping section 51 that is provided continuously with a rear side of the inclined sheath crimping section 49 and crimps the whole circumferential sheath section 15. The core wire crimping sections 47, the inclined sheath crimping sections 49, and the whole circumferential sheath crimping sections 51 are erected so as to slightly spread in the left-right direction upward from both side edges of the base plate section 43. These respective crimping sections, as illustrated in FIG. 2, have an approximately equal height before crimping.

Subsequently, a state after crimping will be described.

Figure 4:
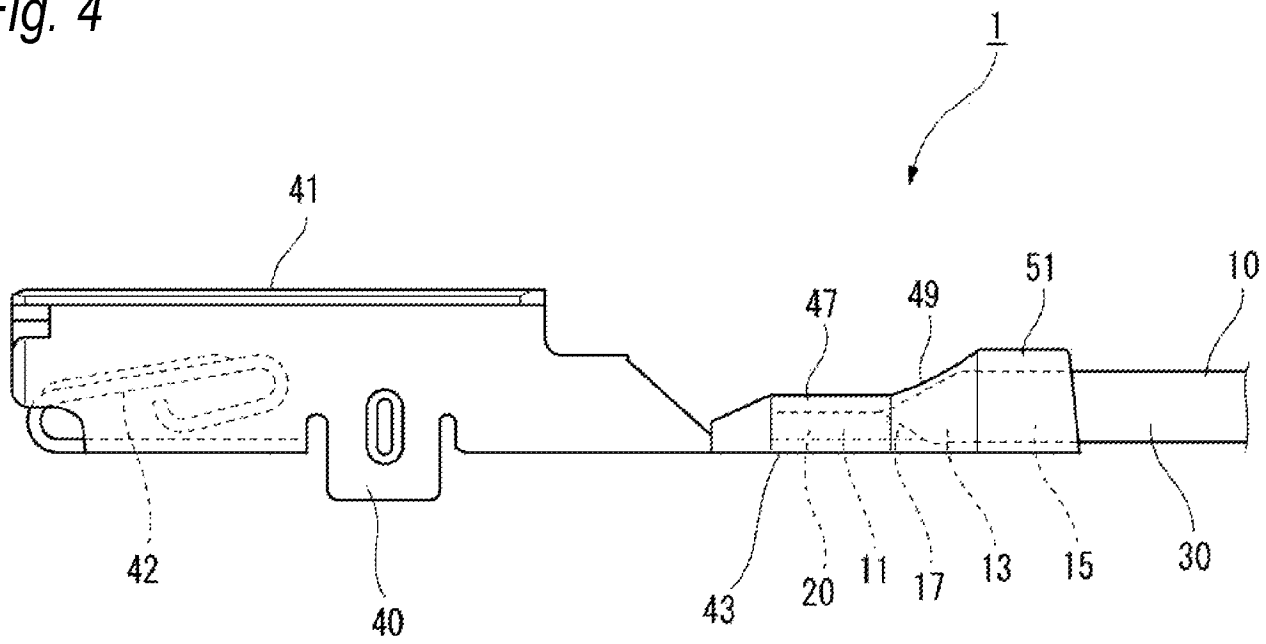
FIG. 4 is a side view in FIG. 1.

In the connection structure 1 related to the first embodiment, as illustrated in FIG. 4, the terminal 40 is crimped to the electric wire 10 so that the end surface 17 of the insulating sheath 30 of the inclined sheath section 13 faces the base plate section 43 (namely, downward). That is, the terminal 40 is crimped to the electric wire 10 so that the base plate section 43 comes into contact with the lower half surface 13*b* of the inclined sheath section 13 in which the exposed portion is wide.

The core wire crimping sections 47, as illustrated in FIGS. 1 and 4, are bent inward so as to wrap the exposed core wire section 11, and are crimped to the core wire exposed section 11 so as to pinch the exposed core wire section 11 between the core wire crimping sections and the base plate sections 43. The core wire crimping sections 47 are bent so that their tips are directed to the base plate section 43 side (downward), and are formed so as to have a substantially B-shaped cross-section, in the cross-sectional view in the direction orthogonal to the front-back direction. That is, the core wire crimping sections 47 are crimped in a B-crimp shape.

The whole circumferential sheath crimping sections 51, as illustrated in FIGS. 1 and 4, are bent inward so as to wrap the whole circumferential sheath section 15, and crimp the whole circumferential sheath section 15 between whole circumferential sheath crimping sections and the base plate sections 43. The whole circumferential sheath crimping sections 51 are bent so that their tips face each other, and are formed so as to have a substantially O-shaped cross-section, in the cross-sectional view in the direction orthogonal to the front-back direction. That is, the whole circumferential sheath crimping sections 51 are crimped in an O-crimp shape.

The inclined sheath crimping sections 49, as illustrated in FIGS. 1 and 4, are bent inward so as to wrap the inclined sheath section 13. In each inclined sheath crimping section 49, a front portion located on the core wire crimping section 47 side is crimped in a shape close to a B crimp, similar to the core wire crimping section 47, and a rear portion located on the whole circumferential sheath crimping section 51 side is crimped in a shape close to an O crimp, similar to the whole circumferential sheath crimping section 51. Additionally, the portion located between the front portion and the rear portion are crimped in an intermediate shape between the B crimp and the O crimp so that the shape thereof shifts in order from the B crimp to the O crimp. For this reason, a gap 53, as illustrated in FIG. 1, is formed between the tips of the inclined sheath crimping sections 49.

The terminal 40, as illustrated in FIG. 4, is crimped to the electric wire 10, in a state where the lower half surface 13*b* of the inclined sheath section 13 in which the exposed portion comes into contact with the base plate section 43 and the upper half surface 13*a* is directed upward. Since the upper half surface 13*a* is crimped by tip sides of the inclined sheath crimping sections 49, the insulating sheath 30 is located between tips of the inclined sheath crimping sections 49, and the above gap 53 is filled with the insulating sheath 30. Particularly, since the end surface 17 is tapered toward a front end, the end surface is easily deformed in the up-down direction, and since the end surface 17 is crimped in the inclined sheath crimping sections 49, the gap 53 is effectively filled. For this reason, entering of water into a contact portion between the core wire 20 and the terminal 40 from the gap 53 is suppressed, and the core wire is prevented from corroding due to the entered water.

Additionally, since the lower half surface 13*b* in which the exposed portion is wide is crimped by base end sides of the inclined sheath crimping sections 49 in a state where the lower half surface is wide comes into contact with the base plate section 43, the exposed core wire 20 of the lower half surface 13*b* is electrically connected to the base plate section 43. For this reason, the electrical connection performance between the core wire 20 and the terminal 40 is enhanced.

Additionally, in the connection structure 1 related to the present embodiment, as illustrated in FIG. 4, the inclined sheath section 13 is crimped not only by the inclined sheath crimping sections 49, but also front ends thereof are crimped by the core wire crimping sections 47. That is, as illustrated in FIG. 4, a portion on the front side of the end surface 17 of the insulating sheath 30 of the inclined sheath section 13 is crimped by the core wire crimping sections 47. Accordingly, the insulating sheath 30 extends in its entirety in the front-back direction between the tips of the inclined sheath crimping sections 49 and 49. For this reason, the gap 53 is effectively filled with the insulating sheath 30.

Next, processes for obtaining the connection structure 1 will mainly be described with reference to FIGS. 5A, 5B, 5C, and 5D. Hereinafter, although an aspect in which a worker does respective tasks will be described in the description of the respective processes, the embodiment of the invention is not limited to this. For example, an aspect in which some or all of the tasks are performed by a mechanical device may be adopted.

Figure 5A:
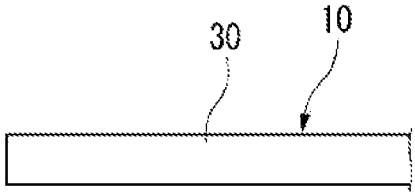
FIG. 5A, FIG. 5B, FIG. 5C, and FIG. 5D are explanatory views illustrating the process for obtaining the connection structure.
Figure 5B:
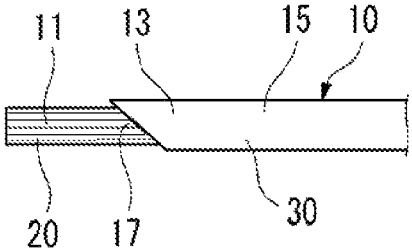

First, as illustrated in FIGS. 5A and 5B, the worker cuts the insulating sheath 30 of the electric wire 10 (the electric wire 10 illustrated in FIG. 5A) in a state where the whole outer circumference of the core wire 20 is covered with the insulating sheath 30, thereby removing the insulating sheath 30 on the front end side and exposing the core wire 20 on the front end side (peeling process).

Figure 5C:
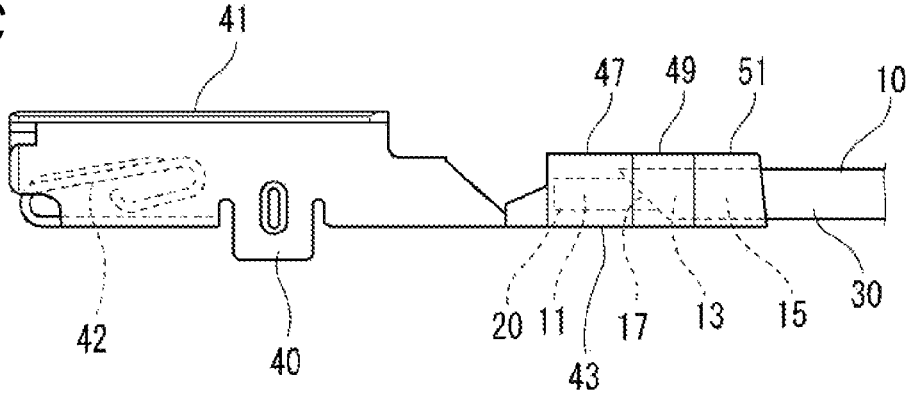

Thereafter, the worker, as illustrated in FIG. 5C, positions and arranges the electric wire 10 with respect to the terminal 40 so as to be arranged at a crimping position that is a position where the electric wire 10 is crimped to the terminal 40. More specifically, as described above, the worker arranges the electric wire 10 between the crimping pieces 45 and 45 of the terminal 40 so as to be located in an orientation in which the end surface 17 of the insulating sheath 30 of the inclined sheath section 13 faces the base plate section 43 and in a place where the front end of the inclined sheath section 13 is crimped to the core wire crimping sections 47 (electric wire arrangement process).

Figure 5D:
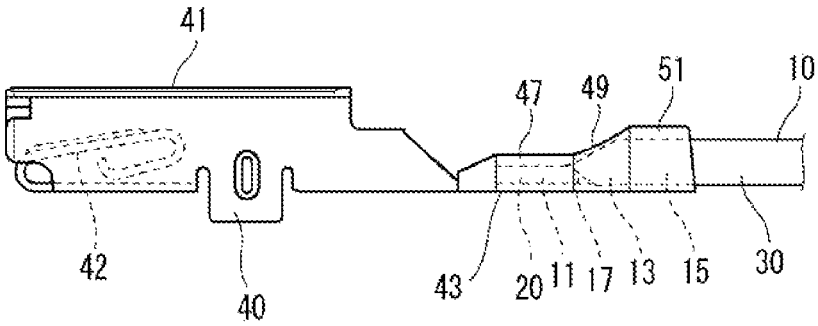

Then, the worker, as illustrated in FIG. 5D, crimps the crimping pieces 45 and 45 and crimps the electric wire 10 to the terminal 40 (crimping process). In this case, the core wire crimping sections 47, the inclined sheath crimping sections 49, and the whole circumferential sheath crimping sections 51 may be simultaneously crimped or may be crimped one by one. Additionally, the order of the crimping can be arbitrarily selected.

The connection structure 1 between the electric wire 10 and terminal 40 in which the terminal 40 is crimped to the electric wire 10 in an orientation in which the end surface 17 of the insulating sheath 30 of the inclined sheath section 13 faces the base plate section 43 is obtained by the processes described above.

Second Embodiment

Figure 6:
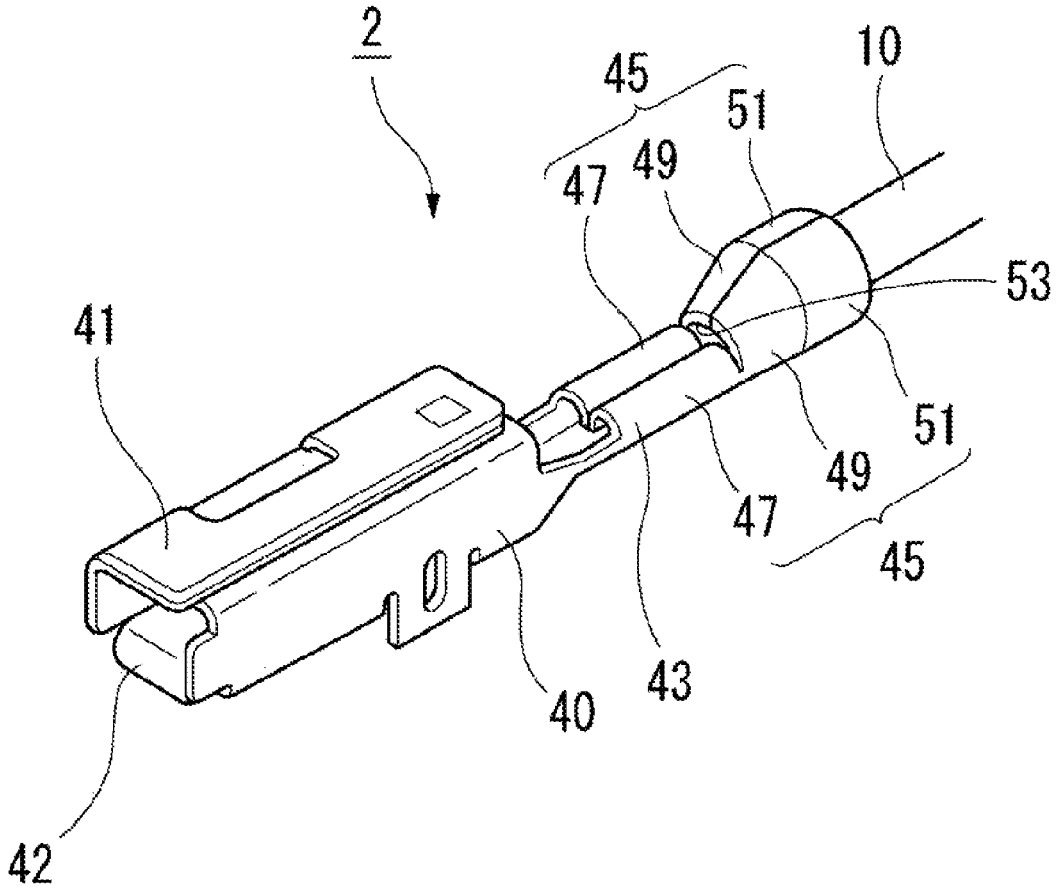
FIG. 6 is a perspective view illustrating a connection structure related to a second embodiment.
Figure 7:
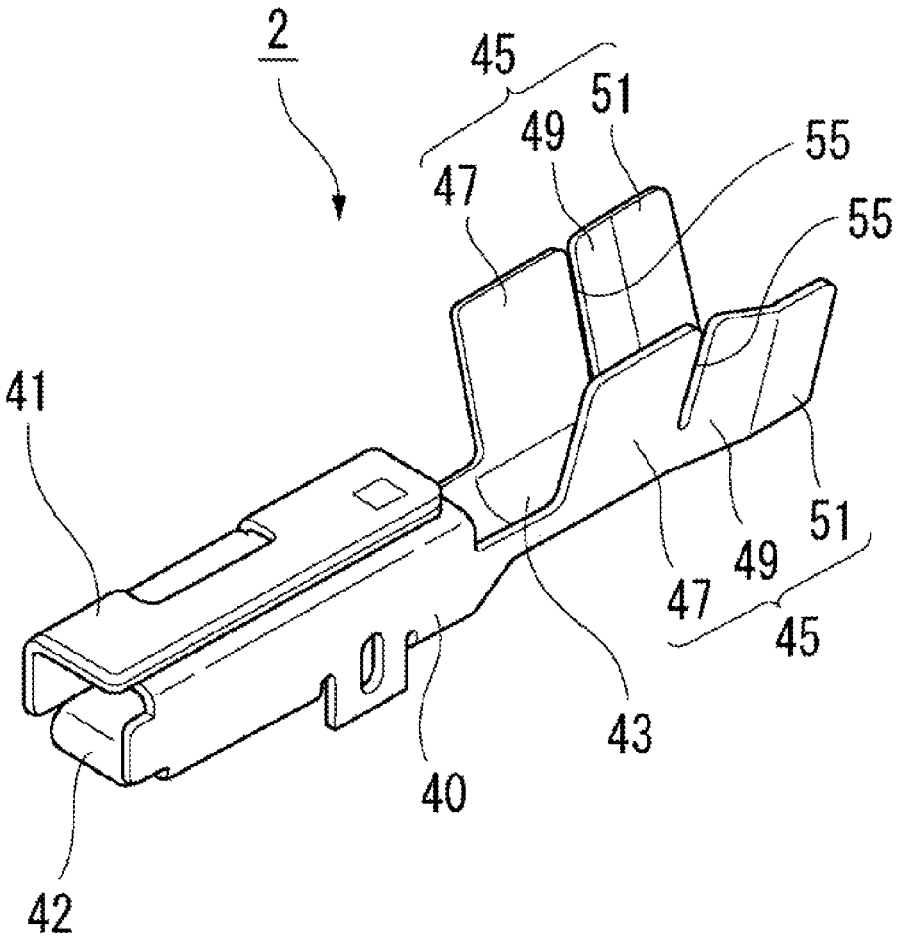
FIG. 7 is a perspective view of a state before the crimping of a terminal of the second embodiment.

FIGS. 6 and 7 illustrate a connection structure 2 between an electric wire and a terminal related to a second embodiment. The connection structure 2 related to the second embodiment is different from the connection structure 1 related to the first embodiment in that slits (in other words, notches) 55 extending from the tips of the core wire crimping sections 47 and the inclined sheath crimping sections 49 are formed between the core wire crimping sections 47 and the inclined sheath crimping sections 49. Since this connection structure is the same as the connection structure 1 in the other points, the same members will be designated by the same reference numerals, and the description thereof will be omitted.

In the connection structure 2 related to the second embodiment, each slit 55 are formed between the core wire crimping section 47 and the inclined sheath crimping section 49. In other words, the core wire crimping section 47 and the inclined sheath crimping section 49 of each crimping piece 45 is partitioned by the slit 55 extending from an upper end (namely, a tip in an erecting direction) of the crimping piece toward the base plate section 43. For this reason, the inclined sheath crimping sections 49, as illustrated in FIG. 6, are crimped in a shape near an O crimp, as a whole. Accordingly, the gap 53 is formed between the core wire crimping sections 47 and the inclined sheath crimping sections 49. Here, also in the second embodiment, the upper half surface 13*a* of the inclined sheath section 13 is crimped by the core wire crimping sections 47 and the inclined sheath crimping sections 49. Therefore, the insulating sheath 30 is located between the core wire crimping sections 47 and the inclined sheath crimping sections 49 and the above gap 53 is filled with the insulating sheath 30. For this reason, entering of water into a contact portion between the core wire 20 and the terminal 40 from the gap 53 is suppressed, and the core wire is prevented from corroding due to the entered water.

Although the above gap 53 is filled with the insulating sheath 30 in this way, a configuration in which an anticorrosive agent (not illustrated) may be further applied to the portion of the gap 53, and waterproofing is achieved may be adopted if necessary. Additionally, a configuration in which a waterproofing agent is also applied to tip portions of the core wire crimping sections 47 may be adopted.

In the connection structure 2 related to the second embodiment, a portion of the electric wire 10 can be visually recognized from the slits 55 in a state where the electric wire 10 is crimped by the crimping pieces 45 and 45. For this reason, the worker can confirm the position of the insulating sheath 30 after crimping by visual observation.

Third Embodiment

Figure 8:
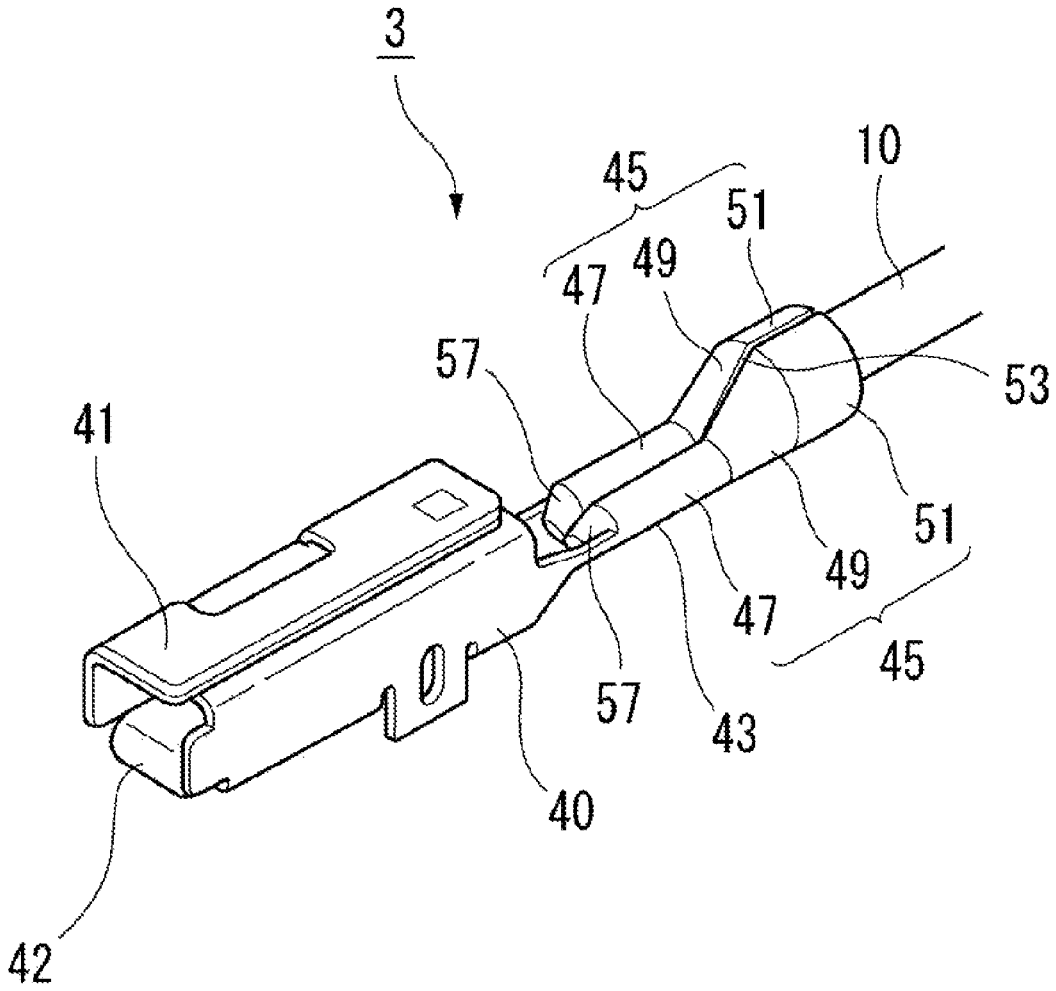
FIG. 8 is a perspective view illustrating a connection structure related to a third embodiment.
Figure 9:
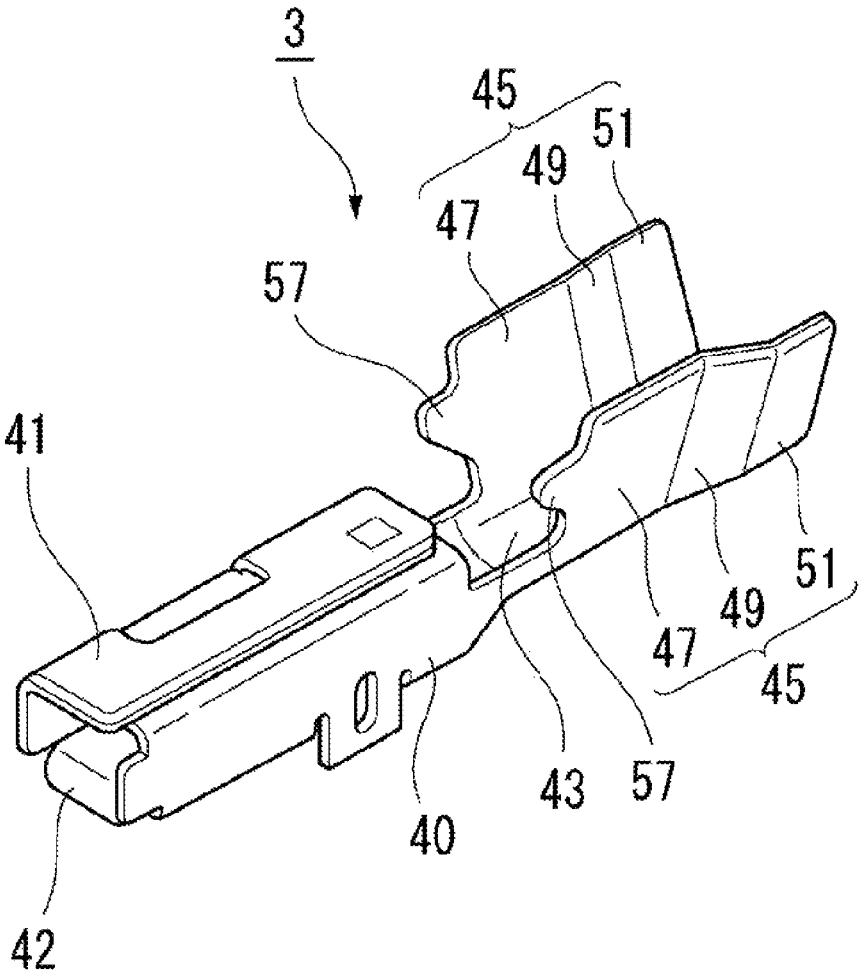
FIG. 9 is a perspective view of a state before the crimping of a terminal of the third embodiment.
Figure 10:
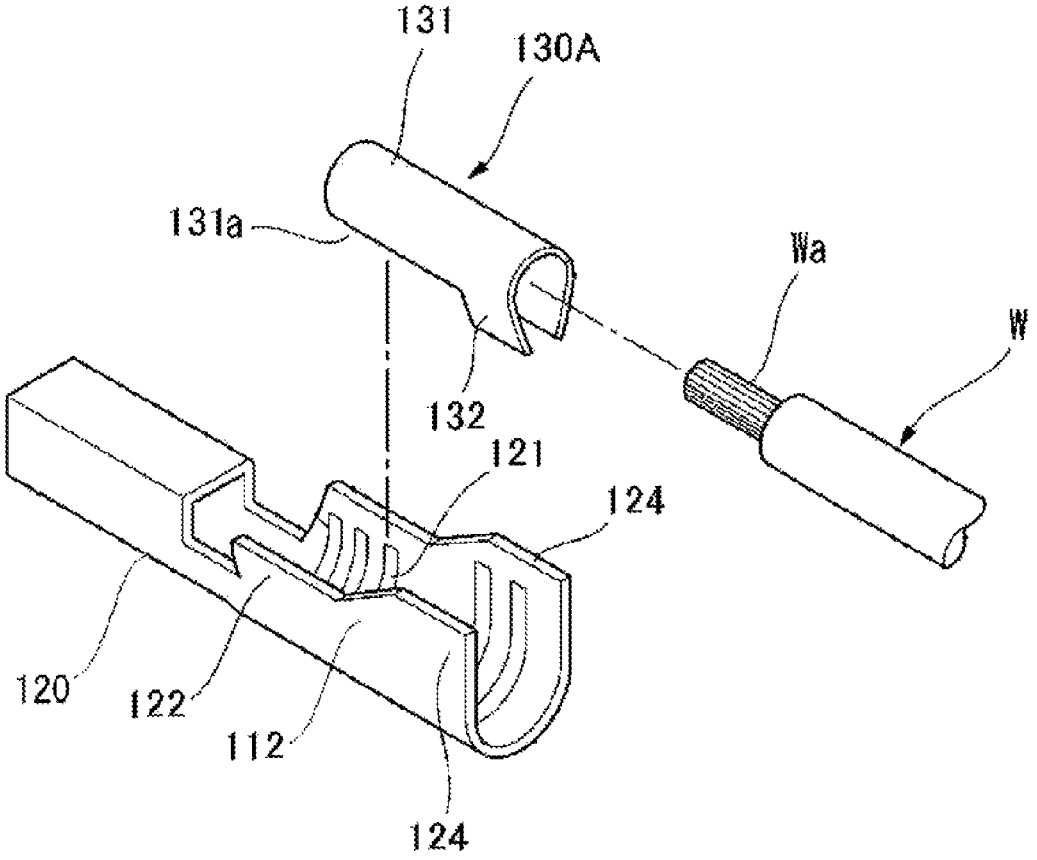
FIG. 10 is a perspective view illustrating a related-art connection structure.

FIGS. 8 to 9 illustrate a connection structure 3 between an electric wire and a terminal related to a third embodiment. The connection structure 3 related to the third embodiment is different from the connection structure 1 related to the first embodiment in that waterproofing sections 57 extending toward the front side are formed at the end portions of the core wire crimping sections 47 on the connection section 41 side (front side). Since this connection structure is the same as the connection structure 1 in the other points, the same members will be designated by the same reference numerals, and the description thereof will be omitted.

In the connection structure 3 related to the third embodiment, the waterproofing sections 57 extending toward the front side are formed from the end surfaces of the core wire crimping sections 47 on the front side. The waterproofing sections 57, as illustrated in FIG. 8, are bent toward the base plate section 43 of the terminal 40 in a state where the electric wire 10 is crimped by the crimping pieces 45 and 45. Accordingly, the front end side of the exposed core wire section 11 is covered with the bent waterproofing sections 57. For this reason, entering of water from the front end side of the exposed core wire section 11 is suppressed, and the core wire is prevented from corroding due to the entered water.

In the following, the working and effects of the connection structure between the electric wire and the terminal related to the embodiments will be described.

The connection structures 1 to 3 between the electric wire and the terminal related to the embodiment are connection structures between the electric wire 10 having the core wire 20 and the insulating sheath 30 that covers the outer circumferential surface of the core wire 20, and the terminal 40 crimped to the terminal section of the electric wire 10 on one end side in the longitudinal direction (that is, the front-back direction). The electric wire 10 has, at the terminal section thereof, the core wire exposed section 11 in which the whole outer circumferential surface of the core wire 20 is exposed from the insulating sheath 30, the whole circumferential sheath section 15 in which the outer circumferential surface of the core wire 20 is covered with the insulating sheath 30, and an inclined sheath section 13 that is formed between the exposed core wire section 11 and the whole circumferential sheath section 15. The inclined sheath section 13 continues to the whole circumferential sheath section 15, and in the inclined sheath section 13, the end surface 17 of the insulating sheath 30 on one end side in the longitudinal direction is inclined in the direction intersecting the longitudinal direction, and thereby, a portion of the core wire 20 is exposed. The terminal 40 includes the connection section 41 that is electrically connected to the mating terminal, the base plate section 43 that is provided continuously with the connection section 41, and the pair of crimping pieces 45 and 45 that are erected from both the side edges of the plate portion 43, respectively. Each crimping piece 45 has the core wire crimping section 47 that crimps the exposed core wire section 11, the whole circumferential sheath crimping section 51 that crimps the whole circumferential sheath section 15, and the inclined sheath crimping section 49 that crimps the inclined sheath section 13. The terminal 40 is crimped to the electric wire 10 so that the end surface 17 of the inclined sheath section 13 faces the base plate section 43.

Accordingly, the upper half surface 13*a* of the inclined sheath section 13 is arranged on the upper end sides of the inclined sheath crimping sections 49. For this reason, the gap 53 formed after crimping to the inclined sheath crimping sections 49 serving as portions where the outer shapes are switched is filled with the insulating sheath 30. Particularly, since the end surface 17 of the inclined sheath section 13 that is easily deformed in the up-down direction is crimped in the inclined sheath crimping sections 49, the gap is easily filled. As a result, entering of water into a contact portion between the core wire 20 and the terminal 40 from the gap 53 is suppressed, and the core wire 20 is prevented from corroding due to the entered water. Accordingly, waterproofing of the contact portion between the core wire 20 and the terminal 40 can be achieved with a simple structure without using the metallic cover unlike the related-art connection structure between the electric wire and the terminal, that is, without increasing the number of parts.

Hence, according to the connection structures 1 to 3 related to the embodiments, it is possible to provide a connection structure capable of realizing cost reduction, while maintaining the performance of inhibiting the entering of water to the conductor of the electric wire and the performance of suppressing the corrosion of the conductor.

Additionally, in the connection structures 1 to 3 between the electric wire and the terminal related to the embodiments, the lower half surface 13*b* of the inclined sheath section 13 is arranged on the base end sides (lower sides) of the inclined sheath crimping sections 49. For this reason, if the electric wire 10 is crimped by the crimping pieces 45 and 45, the exposed core wire 20 is electrically connected to the base plate section 43 of the terminal 40 in the inclined sheath section 13. As a result, while waterproofness is enhanced by filling the gap 53 with the insulating sheath 30 as described above, the insulating sheath 30 does not easily impair the electrical connection performance between the core wire 20 and the terminal 40.

Additionally, in the connection structures 1 to 3 between the electric wire and the terminal related to the embodiments, a portion of the inclined sheath section 13 is crimped by the core wire crimping sections 47 and 47.

Accordingly, the insulating sheath 30 is located in its entirety in the front-back direction between the tips of the inclined sheath crimping sections 49 and 49. For this reason, the gap 53 is effectively filled with the insulating sheath 30.

Additionally, in the connection structure 2 between the electric wire and the terminal applied to the embodiment, the core wire crimping section 47 and the inclined sheath crimping section 49 of each crimping piece 45 is partitioned by the slit 55 extending from the tip (namely, the upper end) of the crimping piece in the erection direction toward the base plate section 43.

Accordingly, since the rigidity of the crimping pieces 45 and 45 decreases, the crimping pieces 45 and 45 are easily crimped. Additionally, the gap 53 is easily formed in the portions where the slits 55 are formed. For this reason, a portion where the gap 53 is formed is easily predicted, and the gap 53 is reliably filled with the insulating sheath 30. Additionally, since a portion of the electric wire 10 can be visually recognized from the slits 55 in a state where the electric wire 10 is crimped by the crimping pieces 45 and 45, the worker can confirm the position of the insulating sheath 30 after crimping by visual observation.

Additionally, in the connection structure 3 between the electric wire and the terminal related to the embodiment, the waterproofing sections 57 extending toward the front side are formed on the end portions of the core wire crimping section 47 on the connection section 41 side (namely, on the front side). The waterproofing sections 57 are bent toward the base plate section 43 of the terminal 40 in a state where the electric wire 10 is crimped by the crimping pieces 45 and 45.

Accordingly, the front end side of the exposed core wire section 11 is covered with the bent waterproofing sections 57. For this reason, entering of water from the front end side of the exposed core wire section 11 is suppressed, and the core wire is prevented from corroding due to the entered water.

In addition, the technical scope of the invention is not limited to the aforementioned embodiments. The above-described embodiments can be accompanied with various modifications, improvements, or the like within the technical scope of the invention.

For example, in the connection structures 1 to 3 related to the embodiments, a configuration in which the front end of the inclined sheath section 13 is crimped also by the core wire crimping sections 47 is provided. However, a configuration in which at least a portion of the end surface 17 of the insulating sheath 30 of the inclined sheath section 13 is crimped by the inclined sheath crimping section 49 may be adopted. For example, a configuration in which the entire end surface 17 is crimped by the inclined sheath crimping sections 49 and is not crimped by the core wire crimping sections 47 may be adopted.

In addition, in the embodiments of the connection structure related to the invention, a structure in which the inclined sheath section 13 does not have the non-exposed section 13*y* and includes only the partially-exposed section 13*x* may be adopted. Even when the inclined sheath section 13 includes only the partially-exposed section 13*x*, in the embodiments of the connection structure related to the invention, a configuration in which the inclined sheath section 13 has the front end portion crimped to the core wire crimping sections 47 as well as the inclined sheath crimping sections 49 may be adopted, or a configuration in which the inclined sheath section is crimped to only the inclined sheath crimping sections 49 may be adopted.

Additionally, only a form in which the end surface 17 of the insulating sheath 30 of the inclined sheath section 13 is crimped by the crimping pieces 45 in an immediately downwardly directed state is illustrated in the connection structures 1 to 3 related to the embodiments. However, it is sufficient so long as a configuration in which the terminal 40 is crimped so that the end surface 17 faces the base plate section 43. For example, a configuration in which the terminal is crimped in a state where the normal line of the end surface 17 inclines slightly in the left-right direction may be adopted.

Additionally, in the connection structures 1 to 3 related to the embodiments, a configuration in which the gap 53 is formed in the inclined sheath crimping sections 49 by crimping the core wire crimping sections 47 in the B-crimp shape, and crimping the whole covering crimping sections 51 in the O-crimp shape is provided. However, the crimping shapes of the core wire crimping sections 47 and the whole circumferential sheath crimping section 51 are not limited to these. Since the exposed core wire section 11 in which the insulating sheath 30 is removed and the core wire 20 is exposed and the whole circumferential sheath section 15 in which the whole outer circumference of the core wire 20 is covered with the insulating sheath 30 are different from each other in outer shapes, the outer shapes of the core wire crimping sections 47 and the whole circumferential sheath crimping sections 51 after crimping are inevitably different from each other. Accordingly, it is sufficient so long as a configuration is adopted in which the end surface 17 of the insulating sheath 30 of the inclined sheath section 13 is crimped by the crimping pieces 45 so as to face the base plate section 43 irrespective of the crimping shapes of the core wire crimping sections 47 and the whole circumferential sheath crimping sections 51.

According to the connection structure related to the invention, the invention is useful in that it is possible to provide a connection structure capable of realizing cost reduction, while ensuring the performance of inhibiting the entering of water to the conductor of the electric wire and the performance of suppressing the corrosion of the conductor.

What is claimed is:

1. An electrical connection structure, comprising an electric wire having a core wire and an insulating sheath that covers an outer circumferential surface of the core wire, and a terminal crimped to a terminal section of the electric wire on one end side in a longitudinal direction, wherein the electric wire includes:

an exposed core wire section in which a whole outer circumferential surface of the core wire is exposed to the terminal section from the insulating sheath;

an entire circumferential sheath section in which the outer circumferential surface of the core wire is covered with the insulating sheath; and an inclined sheath section that is formed between the exposed core wire section and the entire circumferential sheath section, wherein the inclined sheath section continues to the entire circumferential sheath section, wherein, in the inclined sheath section, an end surface of the insulating sheath on one end side in the longitudinal direction inclines in a direction intersecting the longitudinal direction and thereby a portion of the core wire is exposed, wherein the terminal includes a connection section that is electrically connected to a mating terminal, a base plate section that is provided continuously with the connection section, and a pair of crimping pieces that extend upwardly from both side edges of the base plate section, respectively, wherein each of the crimping pieces has a core wire crimping section that crimps the exposed core wire section, an entire circumferential sheath crimping section that crimps the entire circumferential sheath section, and an inclined sheath crimping section that crimps the inclined sheath section, and wherein the terminal is crimped to the electric wire so that the end surface of the inclined sheath section faces the base plate section.

2. The connection structure according to the claim 1, wherein a portion of the insulating sheath of the inclined sheath section is crimped to the core wire crimping sections.

3. The connection structure according to the claim 1, wherein the core wire crimping section and the inclined sheath crimping section of each of the crimping pieces are partitioned by a slit that extends toward the base plate section from a tip of the crimping piece in an erection direction thereof.

4. The connection structure according to the claim 1, wherein waterproofing sections extending toward the connection section are formed at end portions of the core wire crimping sections on the connection section side.

* * * * *